US010322450B2

(12) United States Patent
Henderson et al.

(10) Patent No.: US 10,322,450 B2
(45) Date of Patent: Jun. 18, 2019

(54) ADJUSTABLE FLOW OVERFLOW VORTEX TRANSFER SYSTEM

(71) Applicant: PYROTEK, INC., Spokane, WA (US)

(72) Inventors: Richard S. Henderson, Solon, OH (US); Jason Tetkoskie, Cleveland Heights, OH (US)

(73) Assignee: PYROTEK, INC., Spokane, WA (US)

( * ) Notice: Subject to any disclaimer, the term of this patent is extended or adjusted under 35 U.S.C. 154(b) by 34 days.

(21) Appl. No.: 15/116,625

(22) PCT Filed: Feb. 4, 2015

(86) PCT No.: PCT/US2015/014396

§ 371 (c)(1),
(2) Date: Aug. 4, 2016

(87) PCT Pub. No.: WO2015/120009

PCT Pub. Date: Aug. 13, 2015

(65) Prior Publication Data

US 2016/0346836 A1 Dec. 1, 2016

Related U.S. Application Data

(60) Provisional application No. 61/935,515, filed on Feb. 4, 2014.

(51) Int. Cl.

| | |
|---|---|
| ***B22D 39/00*** | (2006.01) |
| ***F04D 13/08*** | (2006.01) |
| ***F04D 7/06*** | (2006.01) |
| ***B22D 2/00*** | (2006.01) |
| ***B22D 37/00*** | (2006.01) |
| ***B22D 41/00*** | (2006.01) |
| ***F27D 3/14*** | (2006.01) |
| ***F27D 27/00*** | (2010.01) |

(52) U.S. Cl.

CPC ..... *B22D 39/00* (2013.01); *B22D 2/003* (2013.01); *B22D 37/00* (2013.01); *B22D 41/00* (2013.01); *F04D 7/065* (2013.01); *F04D 13/08* (2013.01); *F27D 3/14* (2013.01); *F27D 27/005* (2013.01)

(58) Field of Classification Search

CPC ..... F04D 7/065

See application file for complete search history.

(56) References Cited

U.S. PATENT DOCUMENTS

| | | | |
|---|---|---|---|
| 5,092,821 | A | 3/1992 | Gilbert et al. |
| 5,441,390 | A | 8/1995 | Rapp |
| 6,286,163 | B1 | 9/2001 | Trimble |
| 6,358,467 | B1 | 3/2002 | Mordue |
| 7,841,379 | B1 | 11/2010 | Evans |
| 2008/0314548 | A1 | 12/2008 | Cooper |
| 2011/0142606 | A1 | 6/2011 | Cooper |
| 2013/0101424 | A1 | 4/2013 | Bright |
| 2013/0214014 | A1 | 8/2013 | Cooper |
| 2016/0346836 | A1* | 12/2016 | Henderson ..... F04D 7/065 |

FOREIGN PATENT DOCUMENTS

| | | |
|---|---|---|
| CA | 2284985 | 8/2008 |

* cited by examiner

*Primary Examiner* — Scott R Kastler
(74) *Attorney, Agent, or Firm* — Fay Sharpe LLP

(57) ABSTRACT

The present invention is directed to a molten metal transfer system. The system includes a pump having interchangeable low flow and high flow impellers and selective low flow and high flow transfer troughs.

15 Claims, 14 Drawing Sheets

ADJUSTABLE FLOW OVERFLOW VORTEX TRANSFER SYSTEM

BACKGROUND

Pumps for pumping molten metal are used in furnaces in the production of metal articles. Common functions of pumps are circulation of molten metal in the furnace or transfer of molten metal to remote locations along transfer conduits or risers that extend from a base of the pump to the remote location. Die casting facilities are one example of a typical use of a molten metal transfer pump. Particularly, a molten metal transfer pump is used as one component in a die casting process to move molten metal from a furnace to a mold.

A traditional molten metal transfer pump is described in U.S. Pat. No. 6,286,163, the disclosure of which is herein incorporated by reference. Referring to FIG. 1, the molten metal pump is indicated generally by the reference numeral 10. The pump 10 is adapted to be immersed in molten metal contained within a vessel 12. The vessel 12 can be any container containing molten metal, although the vessel 12 as illustrated is an external well of a reverberatory furnace 13. The pump 10 has a base member 14 within which an impeller (not shown) is disposed. The impeller includes an opening along its bottom or top surface that defines a fluid inlet for the pump 10. The impeller is supported for rotation within the base member 14 by means of an elongate, rotatable shaft 18. The upper end of the shaft 18 is connected to a motor 20. The base member 14 includes an outlet passageway connected to a riser 24. A flanged pipe 26 is connected to the upper end of the riser 24 for discharging molten metal into a spout or other conduit (not shown). The pump 10 thus described is so-called transfer pump, that is, it transfers molten metal from the vessel 12 to a location outside of the vessel 12.

Currently, many metal die casting facilities employ a main hearth containing the majority of the molten metal. A transfer pump is located in a well adjacent the main hearth. The transfer pump draws molten metal from the well in which it resides and transfers it into a conduit and from there to die casters that form the metal articles. The present invention relates to pumps used to transfer molten metal from a furnace to a die casting machine, ingot mould, DC caster, ladle or the like.

Aluminum production has been ongoing for over a century and is still going strong. One of the key factors in the success of aluminum is its recyclability. In fact, recycling has proven so valuable—both economically and ecologically—that recover and recycling has become its own industry, and a highly successful one at that. A common practice since the early 1900s, recycling was a low-profile activity until 1968 when recycling of aluminum beverage cans vaulted the industry into public consciousness. Forty years later, aluminum recycling is supported by a national infrastructure, and by a national mindset that recognizes the importance, value, and ease of aluminum recycling. The aluminum recycling industry has invested hundreds of millions of dollars developing a system of more than 10,000 recycling center nationwide. Sources for recycled aluminum include automobiles, windows and doors, appliances and other products.

In many of these applications an aluminum recycling facility and/or a die cast facility may be required to provide cast aluminum in sizes varying from a few pounds to several thousand pounds. For example, aluminum can be cast into steel deoxidizer products. These aluminum cast products are used as an alloying agent in steel to facilitate deoxidation and also refine the grain. These products may take the form of various shapes, including shot, cone, star, or pyramid. Typically, these forms will provide an article which is less than about 100 lbs. in weight. Alternatively, aluminum is cast into T-bar and/or sow type products. Once cast, the T-bar and sow can be transported easily to a location where it will be remelted and cast into an end product. T-bar and sow products can weigh in excess of 100 lbs.

BRIEF DESCRIPTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

According to a first embodiment, a molten metal pump is provided. The pump includes an elongated tube having a base end and a top end, a shaft disposed within the tube and an impeller rotatable by the shaft, the impeller is disposed proximate the base end, the base end includes an inlet and the top end includes an outlet, the outlet is in fluid communication with a pair of trough members. A first trough member has a first width and a second trough member has a second width. The second width is greater than the first width.

According to a further embodiment, a metal casting operation is provided. The operation includes a molten metal pump configured for elevating a quantity of molten metal above a wall of a furnace. The pump is in fluid communication with at least two troughs, a first trough having a first volume and a second trough having a second volume greater than the first volume. A diverter is positioned to selectively permit molten metal to enter one of the first or second troughs.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detail description of the disclosure when considered in conjunction with the drawings, in which.

DETAILED DESCRIPTION OF THE PREFERRED EMBODIMENTS

Figure 1:
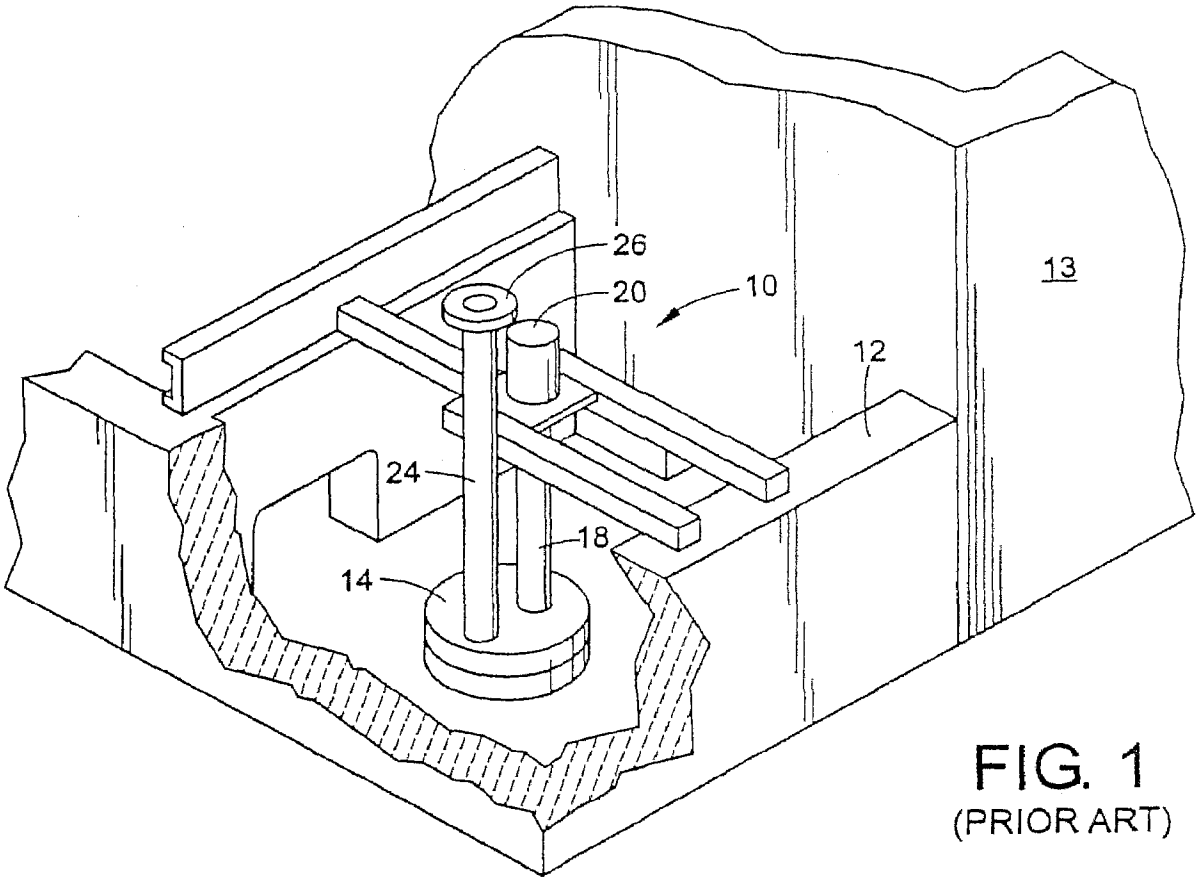
FIG. 1 (PRIOR ART)
FIG. 1 is a schematic view of a prior art system including a furnace, a melting bay and an adjacent bay containing a transfer pump.

One or more embodiments or implementations are hereinafter described in conjunction with the drawings, where like reference numerals are used to refer like elements throughout, and where the various features are not necessary drawn to scale.

Figure 2:
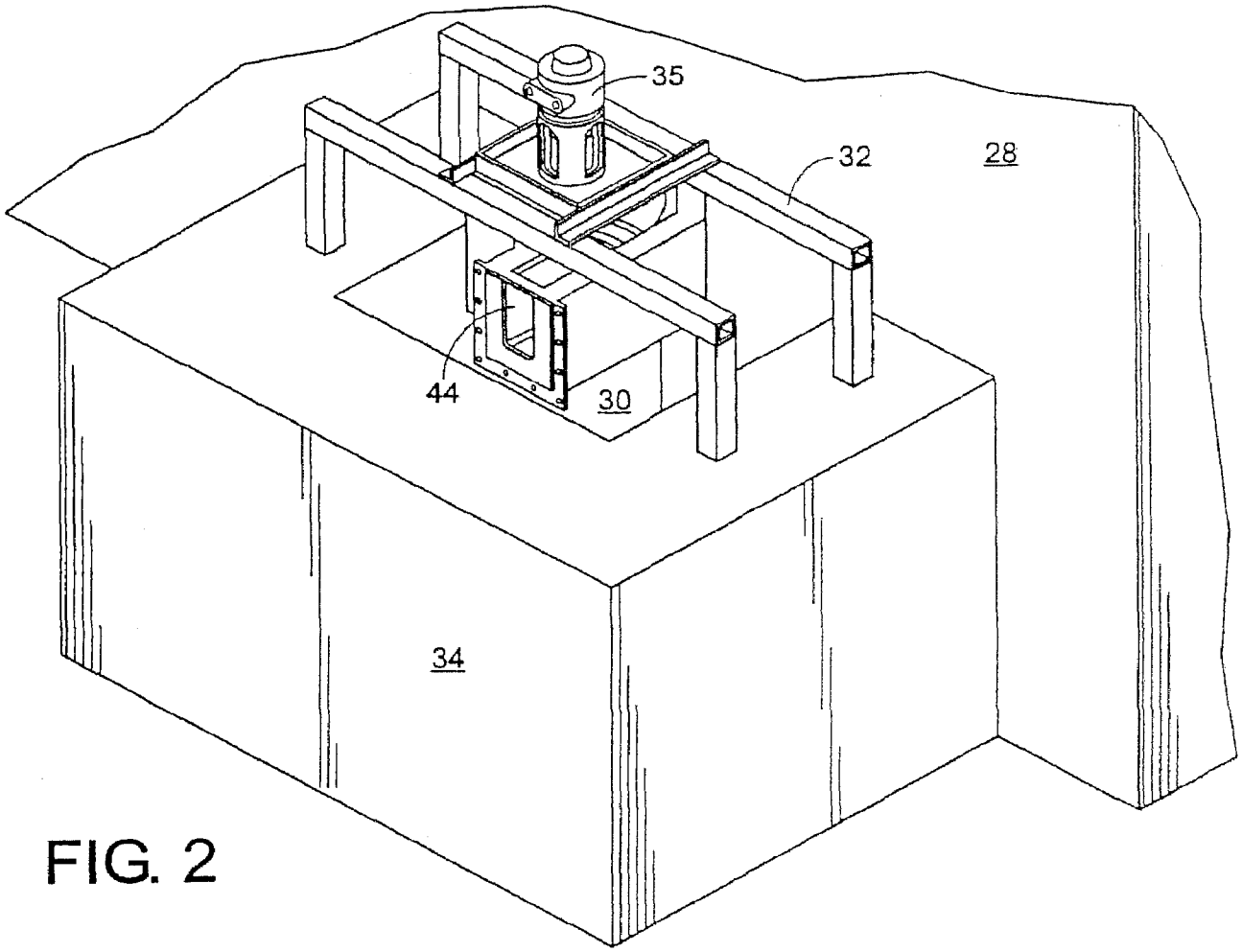
FIG. 2 is a perspective view showing a molten metal transfer system including the pump disposed in a furnace bay.
Figure 3:
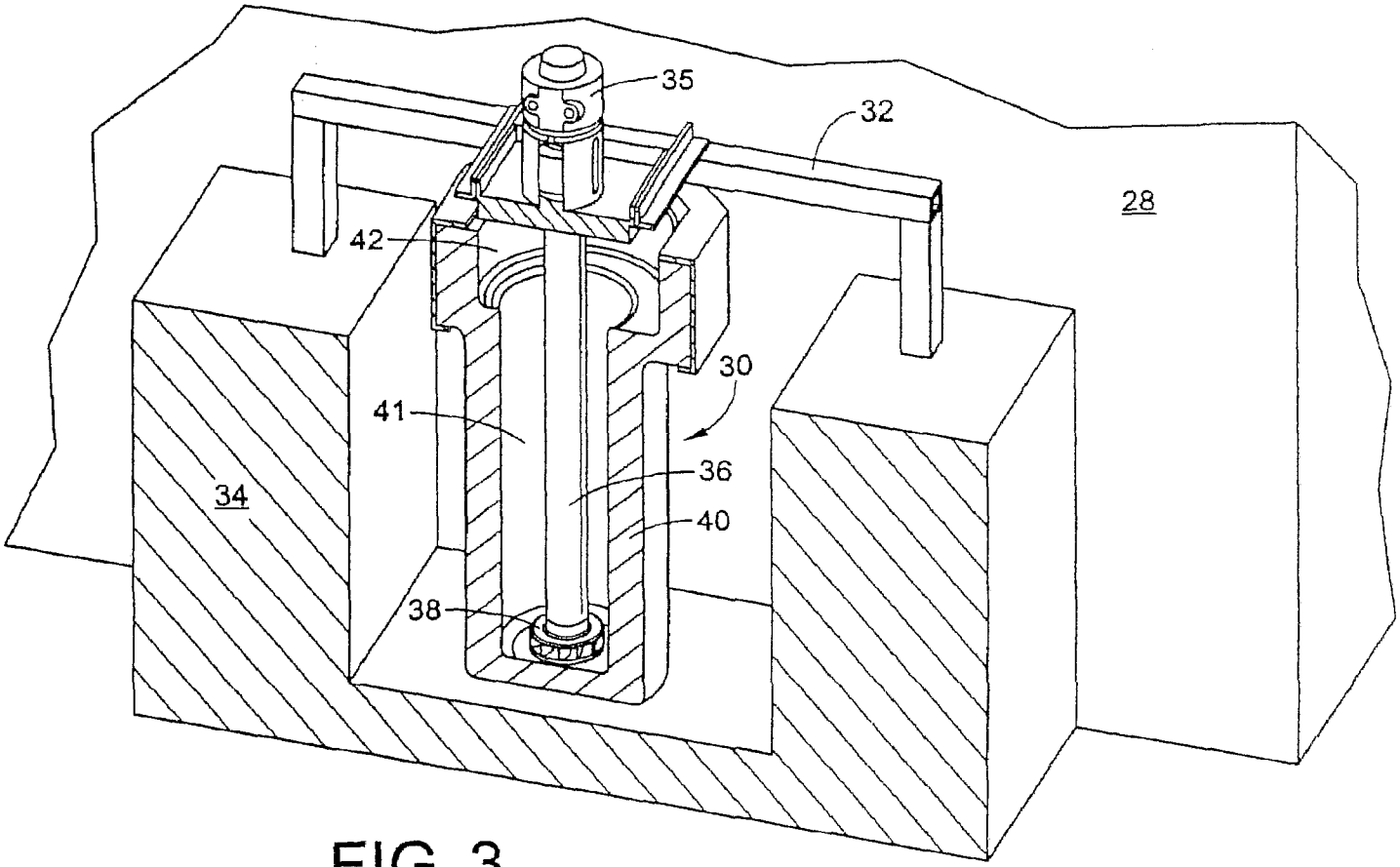
FIG. 3 is a perspective partially in cross-section view of the system of FIG. 2.
Figure 4:
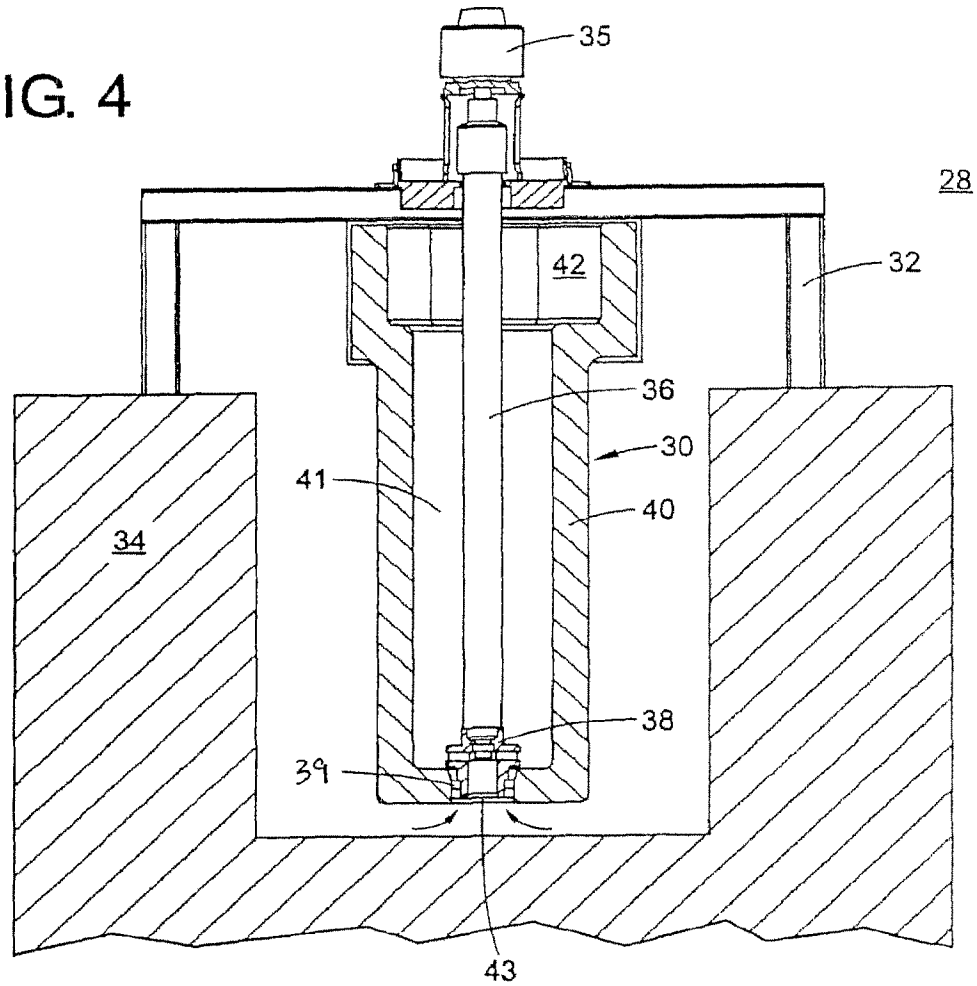
FIG. 4 is a side cross-sectional view of the system shown in FIGS. 2 and 3.

With reference to FIGS. 2-4, the molten metal pump 30 of the present invention is depicted in association with a furnace 28. Pump 30 is suspended via metallic framing 32 which rests on the walls of the furnace bay 34. A motor 35 rotates a shaft 36 and the appended impeller 38. A refractory body 40 forms an elongated generally cylindrical pump chamber or tube 41. The refractory body can be formed, for example, from fused silica, silicon carbide or combinations thereof. Body 40 includes an inlet 43 which receives impeller 38. Preferably, bearing rings 39 are provided to facilitate even wear and rotation of the impeller 38 therein. In operation, molten metal is drawn into the impeller through the inlet (arrows) and forced upwardly within tube 41 in the shape of a forced ("equilibrium") vortex. At a top of the tube 41 a volute shaped chamber 43 is provided to direct the molten metal vortex created by rotation of the impeller outwardly into trough 44. Trough 44 can be joined/mated with additional trough members or tubing to direct the molten metal to its desired location such as a casting apparatus, a ladle or other mechanism as known to those skilled in the art.

Although depicted as a volute cavity 42, an alternative mechanism could be utilized to divert the rotating molten metal vortex into the trough. In fact, a tangential outlet extending from even a cylindrical cavity will achieve molten metal flow. However, a diverter such as a wing extending into the flow pattern or other element which directs the molten metal into the trough may be preferred.

In addition, in certain environments, it may be desirable to form the base of the tube into a general bell shape, rather than flat. This design may produce a deeper vortex and allow the device to have improved function as a scrap submergence unit.

Figure 5:
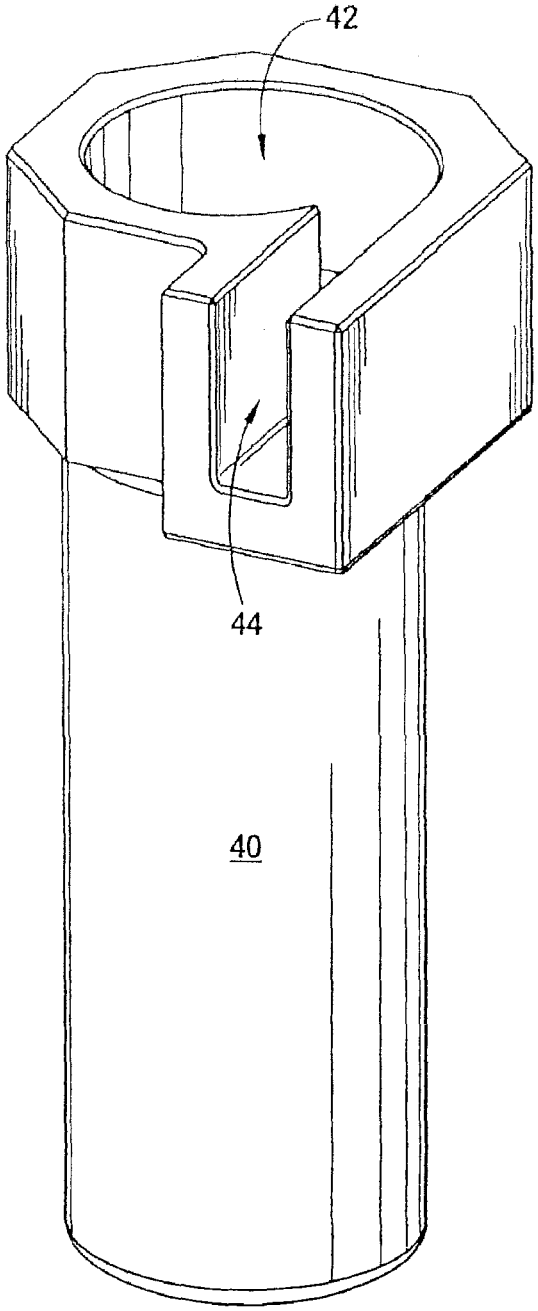
FIG. 5 is a perspective view of the pumping chamber.
Figure 7:
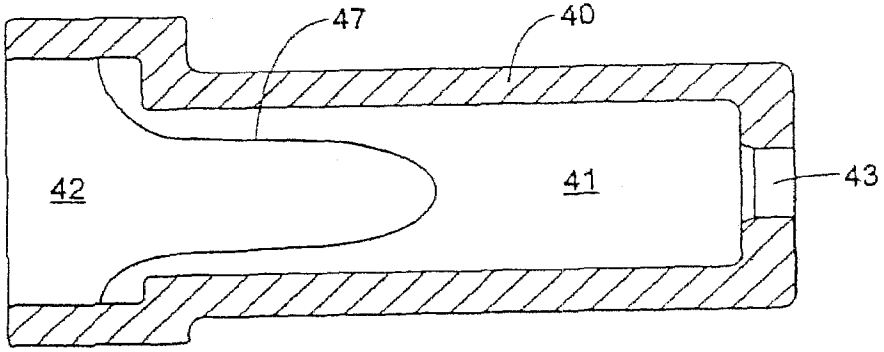
FIG. 7 is a view along the line A-A of FIG. 6.
Figure 6:
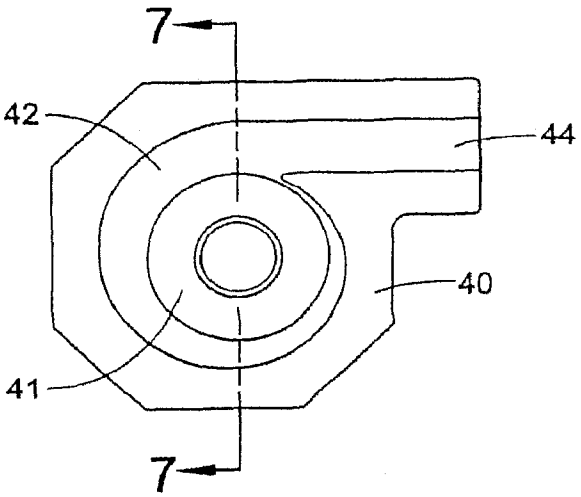
FIG. 6 is a top view of the pumping chamber.

Turning now to FIGS. 5-7, the tube 41 is shown in greater detail. FIG. 5 shows a perspective view of the refractory body. FIG. 6 shows a top view of the volute design and FIG. 7 a cross-sectional view of the elongated generally cylindrical pumping chamber. These views show the general design parameters where the tube 41 is at least 1.1 times greater in its interior diameter, alternatively at least about 1.4 times, greater than the impeller diameter. A range between about 1.4 and 2.0 may be particularly beneficial. However, for higher density metals, such as zinc, it may be desirable that the impeller diameter relative to pumping chamber diameter be at the lower range of 1.1 to 1.3. In addition, it can be seen that the tube 41 is significantly greater in length than the impeller is in height. Preferably, the tube length (height) is at least three times, more preferably at least 10 times, greater than a height of the impeller. Without being bound by theory, it is believed that these dimensions facilitate formation of a desirable forced ("equilibrium") vortex of molten metal as shown by line 47 in FIG. 7.

Figure 8:
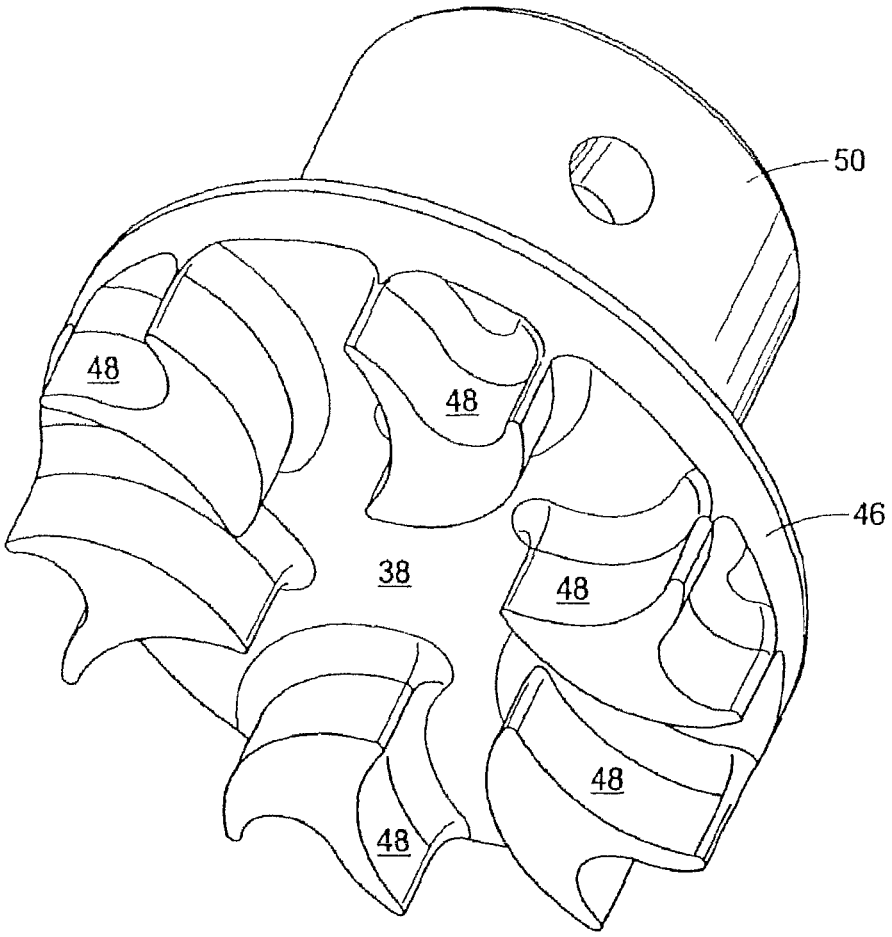
FIG. 8 is a perspective view of the impeller top section.
Figure 9:
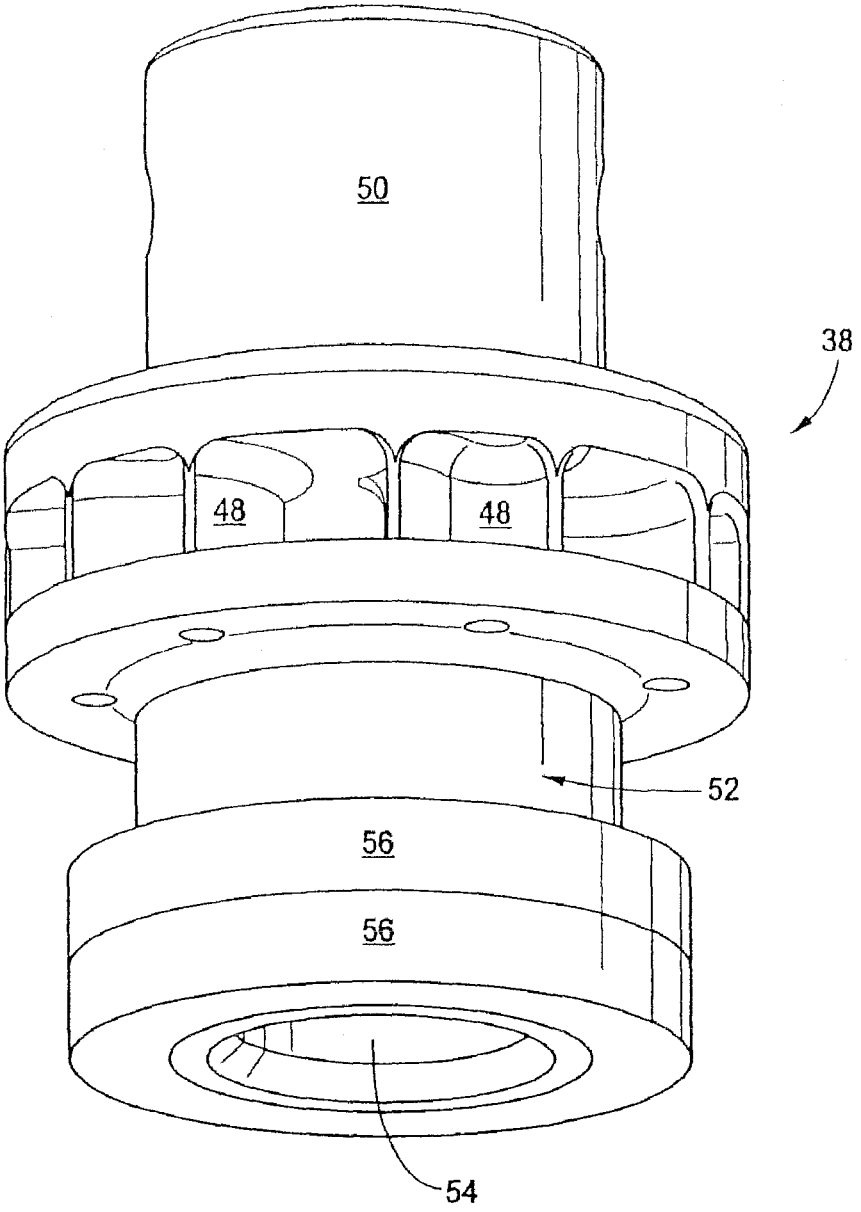
FIG. 9 is a perspective view of the assembled impeller.

FIGS. 8 and 9 depict the impeller 38 which includes top section 46 having vanes 48 supplying the induced molten metal flow and a hub 50 for mating with the shaft 36. In its assembled condition, impeller 38 is mated via screws or bolts to an inlet guide section 52 having a hollow central portion 54 and bearing rings 56. The impeller can be constructed of graphite or other suitable refractory material. It is envisioned that any traditional molten metal impeller design would be functional in the present overflow vortex transfer system.

Figure 10:
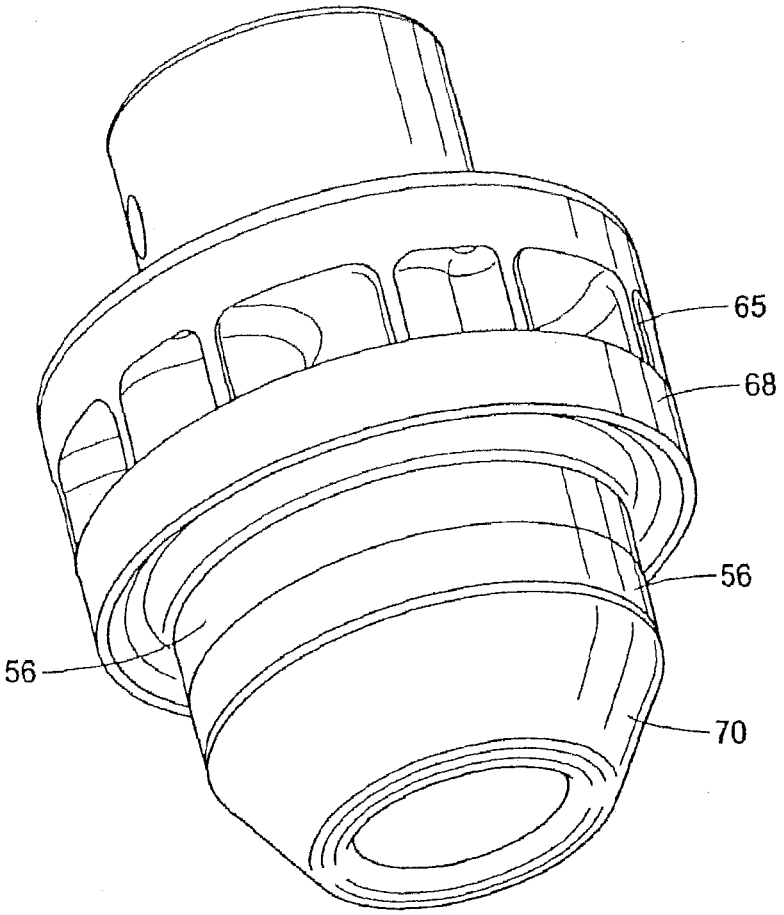
FIG. 10 is an alternative impeller design.
Figure 11:
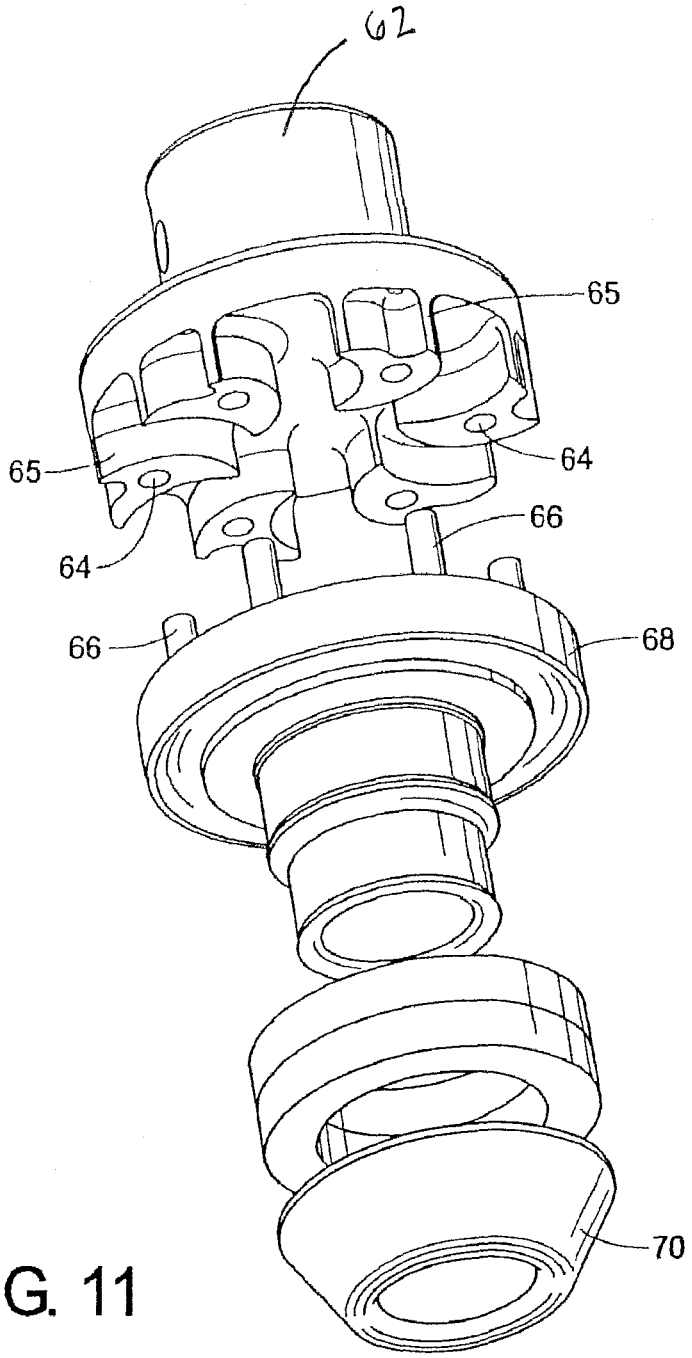
FIG. 11 is an exploded view of the impeller of FIG. 10.

Referring now to FIGS. 10 and 11, an alternative impeller design is depicted. In this embodiment, the impeller top section 62 includes bores 64 in the vanes 65 which receive posts 66 to facilitate proper registration of the components and increase the mating strength. In addition, the inlet guide section 68 has been extended relative to the prior design to include bearing rings 56 and added alignment element 70. Particularly, alignment element 70 is received within a the cooperatively shaped inlet 43.

Figure 12:
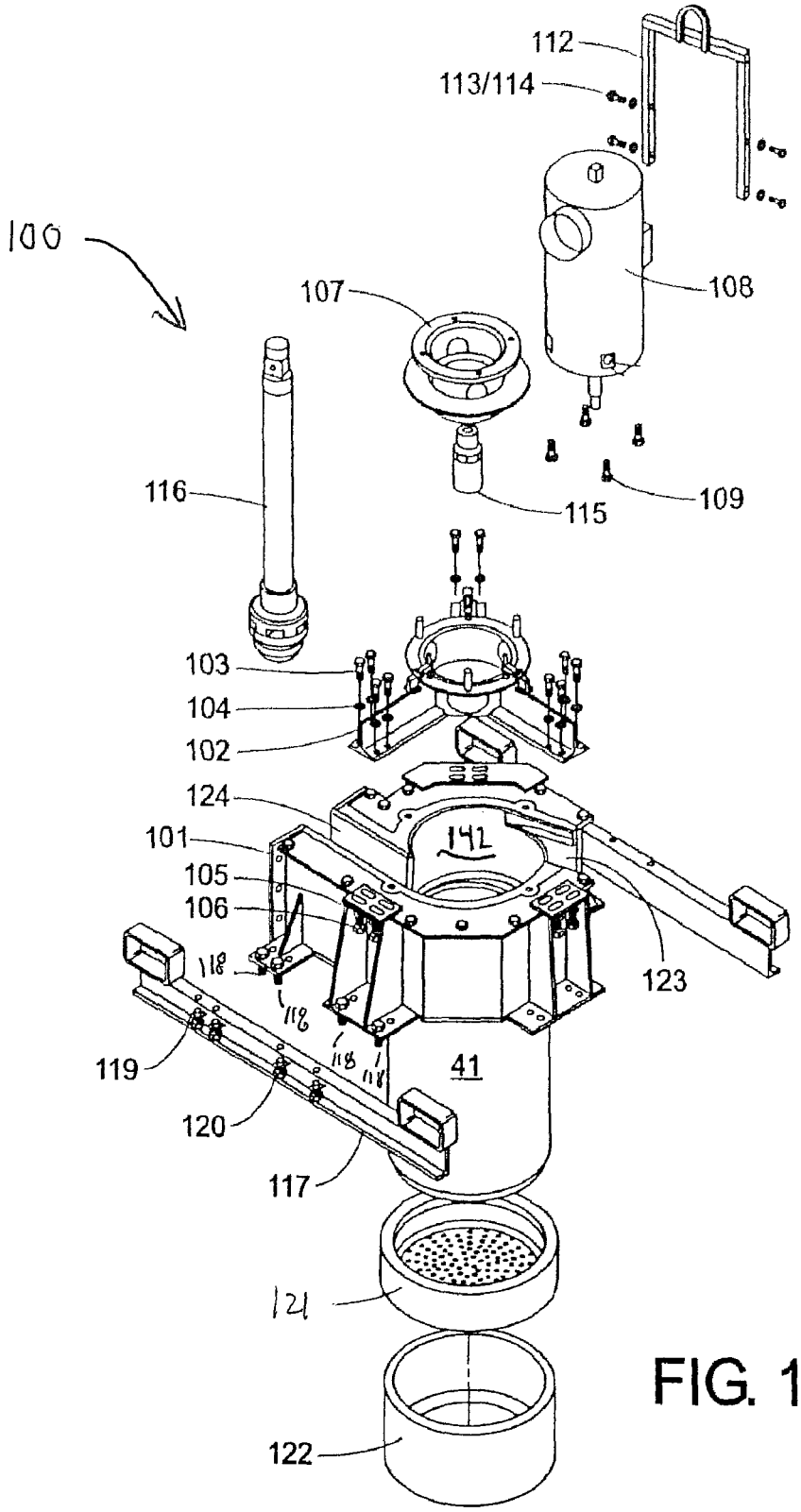
FIG. 12 is an alternative embodiment with an electric motor.

Referring now to FIG. 12, the pump assembly 100 has a metal frame 101 surrounding the top portion (cavity 142) of the refractory tube 41, and includes a motor mount 102 which supports a motor 108. The motor mount assembly 102 is secured to together via hex bolts 103, flat washers 104, lock washers 105 and hex nut 106. Motor adaptor assembly 107 joins electric motor 108 to the motor mount 102. Particularly, hex bolts 109 provide the mating between electric motor adaptor assembly 107 and electric motor 108. A hanger 112 is provided to facilitate the lifting of the assembly. Hanger 112 is secured to the motor via hex bolts 113 and flat washers 114. Heat break coupling assembly 115 mates the motor drive shaft to the shaft and impeller assembly 116. A mounting support assembly 117 including hex bolts 118, bevel washer 119 and hex nut 120 is provided to secure the assembly to the furnace. A strainer 121 and/or a filter cap 122 are provided to protect against ingress of unwanted debris into the pump. In this embodiment, a compressible fiber blank can be disposed between the steel frame and the refractory bowl to accommodate variations in thermal expansion rates. Furthermore, in this embodiment the outlet chamber is provided with an overflow notch 123 to safely return molten metal to the furnace in the event of a downstream obstruction which blocks primary outlet trough 124. Overflow notch 123 has a shallower depth than primary outlet trough 124.

Figure 13:
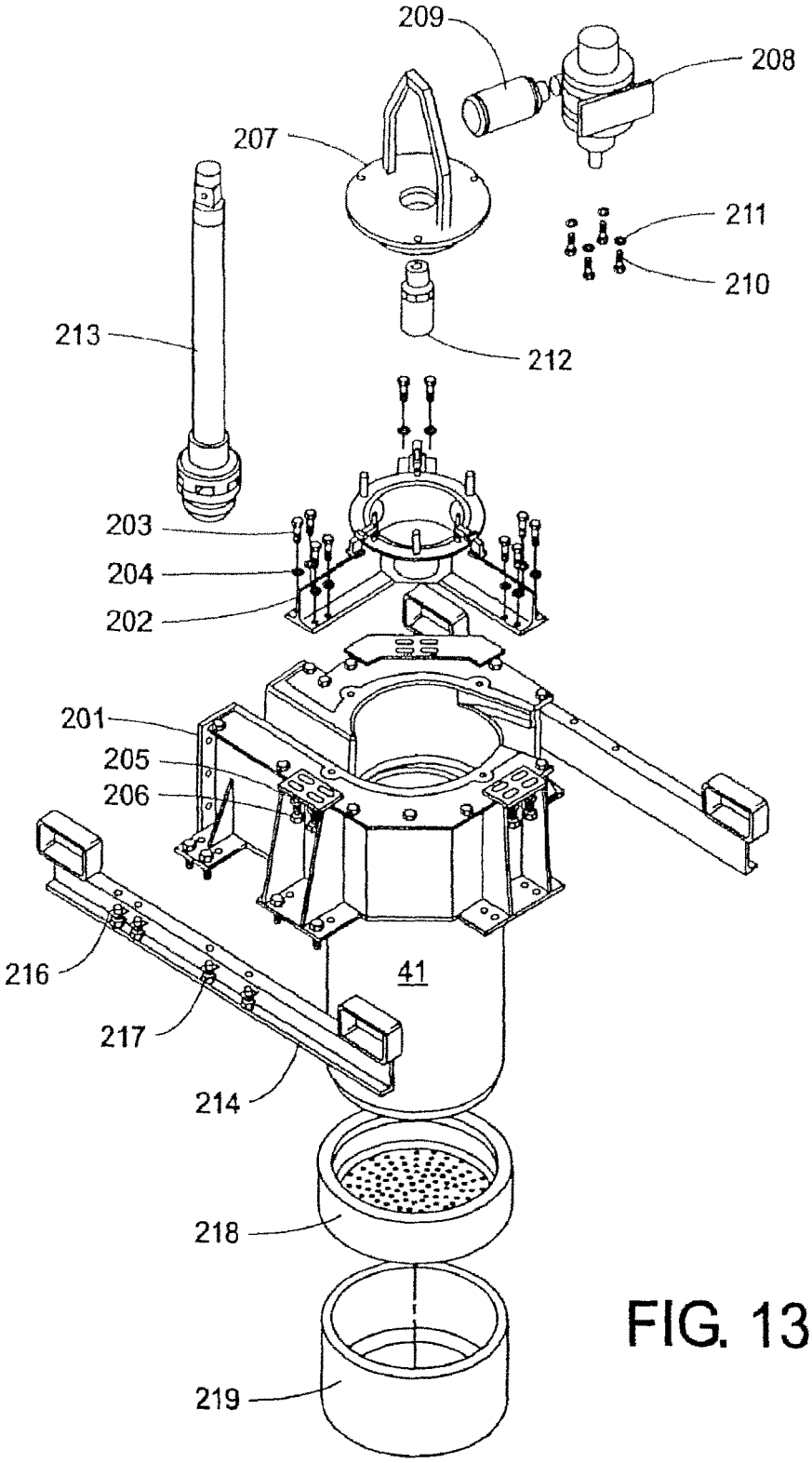
FIG. 13 is a further alternative embodiment with an air motor.

Referring now to FIG. 13, an overflow pump with an air motor option is depicted. Particularly, a metal frame 201 surrounds tube 41 and is mated to a motor mount assembly 202 via hex bolts 203, flat washers 204, lock washers 205 and hex nuts 206. Motor adapter assembly 207 facilitates mounting of the air motor 208 thereto. Air motor 208 includes a muffler 209 and is secured to the air motor adapter assembly 207 via hex bolts 210, and lock washers 211. A heat break coupling 212 mates the drive shaft of the air motor 207 to shaft and impeller assembly 213. Mounting support assembly 214 is provided to secure the unit to the refractory furnace. Particularly, hex bolts 215, bevel washers 216 and hex nuts 217 provide securement thereof. In addition, strainer 218 and/or filter cap 219 are provided.

The invention has many advantages in that its design creates a forced vortex, creating a smooth surface with little to no air intake. Accordingly, the vortex is non-violent and creates little or no dross. In addition, the forced vortex created by the system has a substantially constant angular velocity such that the column of rotating molten metal rotates as a solid body having very little turbulence.

Other advantages include the elimination of the riser component in traditional molten metal pumps which can be fragile and prone to clogging and damage. In addition, the design provides a very small footprint relative to the traditional transfer pump base and has the ability to locate the impeller very close to the bay bottom, allowing for very low metal draw down. As a result of the small footprint, The device is suitable for current refractory furnace designs and will not require significant modification thereto.

The pump has excellent flow tunability, its open design structure provides for simple and easily cleaning access. Advantageously, only shaft and impeller replacement parts will generally be required. In fact is generally self-cleaning wherein dross formation in the riser is eliminated because the metal level is high. Generally, a lower torque motor, such as an air motor, will be sufficient because of the low torque experienced.

Optional additions to the design include the location of a filter at the base of the inlet of the pumping chamber. It is further envisioned that the pump would be suitable for use in molten zinc environments where a very long, pull (e.g. 14 ft.) is required. Such a design may preferably include the addition of a bearing mechanism at a location on the rotating shaft intermediate the motor and impeller. Furthermore, in a zinc application, the entire construction could be manufactured from metal, such as steel or stainless steel, including the pumping chamber tube, and optionally the shaft and impeller.

As stated previously, there are many situations which may require a molten metal processor to handle the molten metal (e.g. aluminum, zinc, silicon and/or magnesium) at varying speeds. In this regard, once a desired metal composition in its metal molten state has been attained within a furnace, it is desirable to transport the molten metal from the furnace to a casting location. The overflow transfer pump described in the preceding paragraphs provides such a device. By providing the overflow transfer pump with at least two troughs of varying dimension, divergent rates of molten metal flow can be provided. This can be desirable when, for example, a casting facility wants to cast a portion of the molten metal into relatively small size articles, deox cones for example, and cast a portion of the molten metal into a relatively large size article, sows for example.

In certain applications, an aluminum manufacturer may desire the ability to provide molten metal at a rate of approximately 150 lbs. per minute or less for an application such as deox cone castings. The same manufacturer may also desire the ability to cast a large sow of aluminum which may require a flow rate of, for example, 1,000 lbs. per minute or more. The present embodiment provides a trough sufficiently large to accommodate at least a 1,000 lbs. per minute flow rate and a trough accommodating a flow rate of less than 150 lbs. per minute. In this regard, although the the large volume trough can accommodate a lesser flow, its dimensions create an excessive surface area of exposed molten metal resulting in undesirable oxidation.

Figure 14:
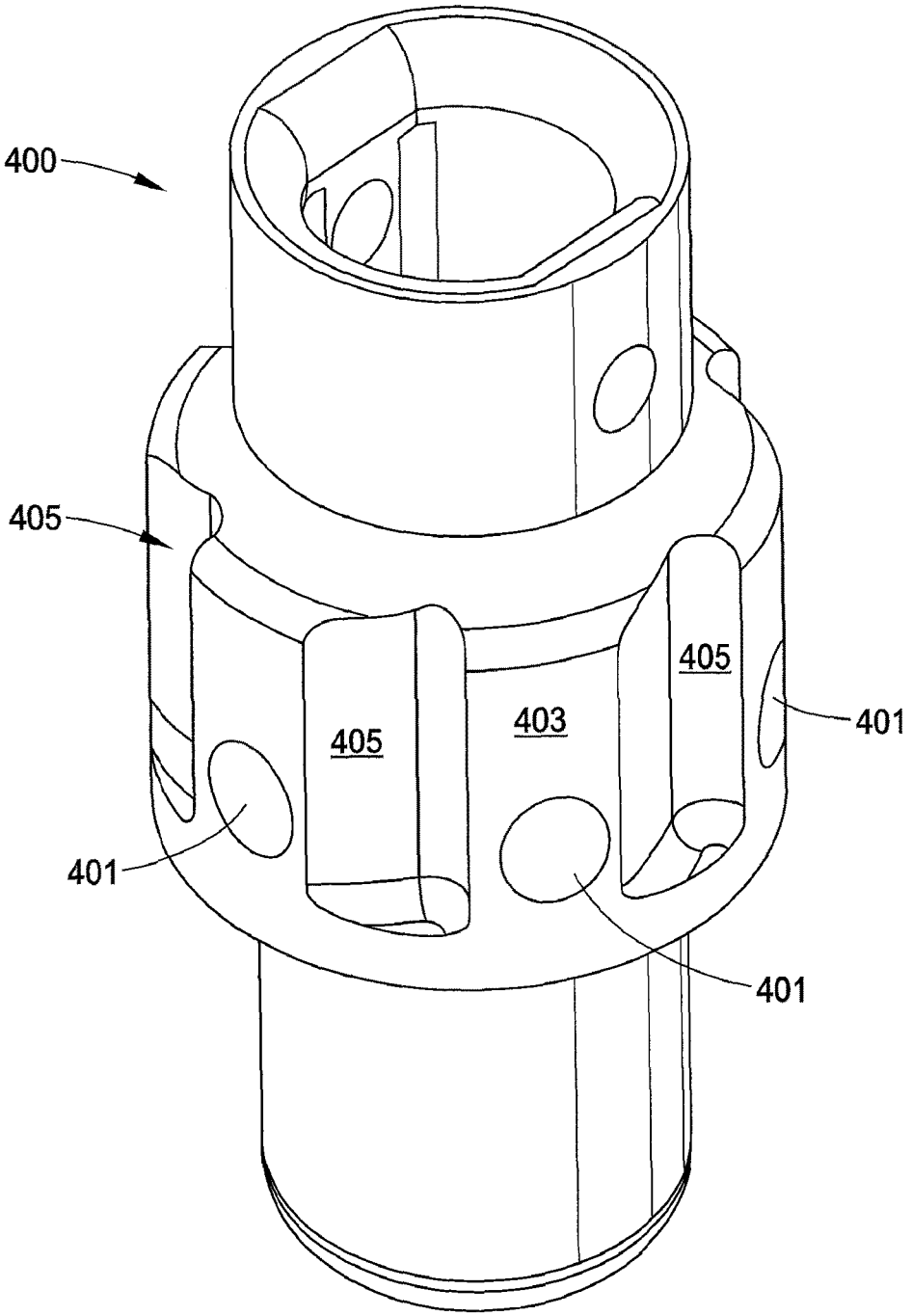
FIG. 14 is a perspective view of a high flow impeller.

The apparatus can be further improved by providing a low flow impeller and a high flow impeller. A low flow impeller can be, for example, the type depicted in FIGS. 8-11, while a high flow impeller can be for, example, the type depicted in FIG. 14. More particularly, the impeller 400 of FIG. 14 includes a bottom inlet design (as does the low flow version of FIGS. 8-11) and includes outlet passages 401 in a sidewall 403. In the FIG. 14 embodiment, the outlet passages 401 are larger than the outlet passages of the low flow embodiment. Furthermore, the outlet passages 48 of the low flow impeller are narrow adjacent the impeller interior and wider adjacent the impeller exterior. This widening of the outlet passage can result in a decrease in the metal velocity passing therethrough.

In contrast, the passages 401 of the high flow impeller are of a relatively larger constant dimension from impeller interior to the impeller exterior. In addition, high flow impeller 400 includes a plurality of pockets 405 disposed in the sidewall 403. Pockets 405 have the effect of increasing the velocity of molten metal being discharged radially from the impeller. By increasing the velocity of the radial discharged molten metal, a higher speed vortex can be created within the pump body.

A low flow impeller will be of a design capable of providing a maximum flow rate of less than 500 lbs. per minute at an RPM of 535. A high flow impeller will be capable of providing a molten metal flow rate of at least 1,000 lbs. per minute at an RPM of 720.

The low flow impeller and the high flow impeller should have approximately the same exterior dimensions to facilitate the positioning thereof within the inlet to the pump base. The selection of either a low flow impeller or a high flow impeller based on the intended flow rate of molten metal is advantageous because pumps tend to operate most effectively at a turn down rate from full speed operation of about 3. Accordingly, a pump operating at a top end and providing 1,200 lbs. of molten metal per minute would provide effective operation down to about 400 lbs. per minute (turn down rate of 3). Such a pump is less effective for casting small pieces requiring, for example, less than 150 lbs. per minute of molten metal. Moreover, at such a large turn down rate, precise control of the pump and its rate of molten metal flow is not generally feasible. Accordingly, providing the present embodiment wherein both the impeller and a trough size are selected for optimal molten metal flow rates based on the size of casting to be formed provides an improved system.

It may be desirable to provide the impeller as a component of a shaft and impeller assembly having a quick disconnect feature such as the Quad Drive Shaft Coupling available from Pyrotek, Inc. of Solon, Ohio, and/or as described in U.S. Pat. No. 6,358,467 or 5,092,821, which are herein incorporated by reference. In this manner, a cast house operator can rapidly change between a high flow operation using of the high flow impeller with selection of the large trough and a low flow impeller with diversion of the molten metal flow to the smaller trough. Diversion can be achieved by installation of a dam member into the deselected trough. In most situations the dam member can be placed at the entrance to the trough.

It may be further desirable for the molten metal outlet and/or one or both of the troughs to be equipped with an apparatus for determining the molten metal level. For example, a laser can be utilized for determining molten metal levels. The laser can provide the molten metal level within either of the troughs to a processor controlling the rotational speed of the motor associated with the shaft and impeller assembly to provide real time control of the rate of operation of the pump which will allow the pump and associated molten metal flow to match the metal casting pace of the system.

Figure 15:
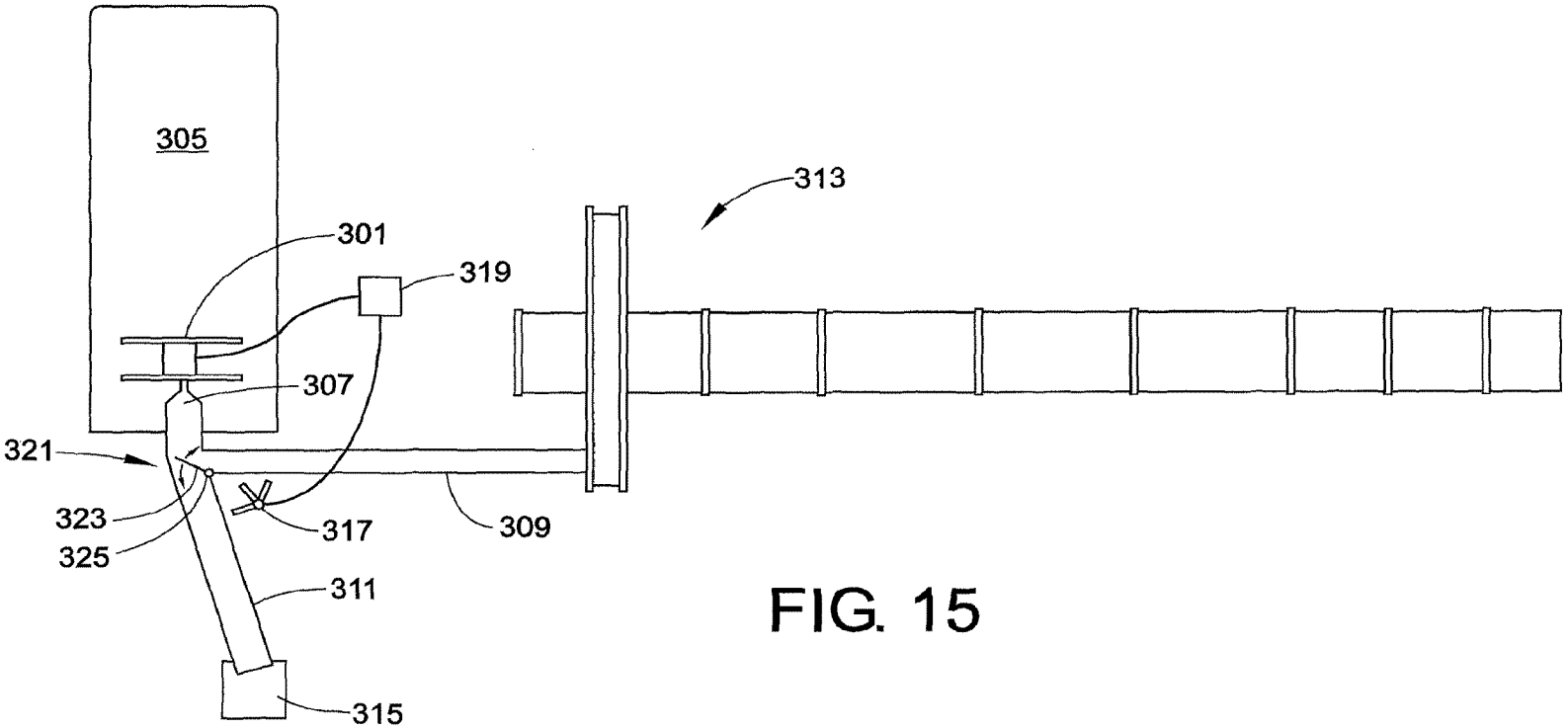
FIG. 15 is a schematic illustration of a cast house system providing high flow and low flow lines.

With reference now to FIG. 15, the trough arrangement of the present embodiment is depicted. Particularly, a molten metal pump casting system is depicted and includes a molten metal pump 301 disposed within a well of a furnace 305. Pump 301 can be of the type depicted and described hereinabove or could alternatively be a transfer type described in U.S. Pat. No. 6,286,163, CA 2284985, or U.S. Published Application 2008/0314548, each of which is herein incorporated by reference.

In this embodiment, a pump outlet 307 is in fluid communication with a first trough member 309 and a second trough member 311. Trough 309 can be in fluid communication with a deox caster 313. The trough member 311 having a larger volume can be in fluid communication with a ladle device 315. Trough member 311 can have a larger dimension(s) than trough member 309 to facilitate a higher volume of molten metal flow therethrough. Typically, one or both of the width and depth of the trough can be increased to add flow volume. Accordingly, the high flow trough 311 can have a width and/or depth greater than the width and/or depth of the low flow trough 309.

In select embodiments, the trough members 309 and 311 will be inclined in a direction towards the pump such that when not actively casting and upon cessation of impeller rotation, molten metal will flow backward into the pump and the furnace within which the pump resides. A slope of, for example, 2" over a 24' run can be suitable for this purpose.

As stated previously, laser apparatus 317 can be provided to measure the height of molten metal within the outlet 307 or in either of the trough members 309 and 311 and provide molten metal levels to a controller 319 operating the pump motor and the associated impeller. In this manner, the rotational speed of the impeller can be adjusted to maintain a desired molten metal height within the trough as required to match the casting rate of the process being performed.

Selection of either the low flow trough 309 or the high flow trough 311 can be performed via the utilization of a dam member 321. Dam member 321 can be a door 323 secured by a hinge 325 at the intersection of trough members 309 and 311 and capable of rotating such that either of the trough member 309 and trough member 311 can be selectively closed to molten metal flow from the pump. The door 323 can be constructed of a refractory material such a s graphite or ceramic to provide longevity of service.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal transfer apparatus comprising an elongated tube having a base end and a top end, a shaft disposed within said tube and an impeller rotatable by said shaft, said impeller disposed proximate said base end, said base end of the tube including an inlet and said top end of the tube including an outlet, said outlet of the tube being in fluid communication with a pair of trough members comprising a first trough member having a first width and a second trough member having a second width, said second width being greater than said first width, wherein the first trough member has a first depth and the second trough member has a second depth and wherein the second depth is greater than the first depth, said pump further including interchangeable shaft and impeller configurations, said impellers having approximately the same exterior dimensions but different flow rates wherein a first combination provides a higher flow rate than a second combination, each impeller including passages between a bottom inlet and a side outlet, the impeller of the first combination having larger passages than the impeller of the second combination, the passages of the second impeller having a wider outlet than inlet, and the impeller of the first combination including pockets disposed in a sidewall, and wherein the first combination is used in association with the second trough and the second combination is used in association with the first trough.

2. The apparatus of claim 1 including a diverter suitable for closing one of said first and second trough members.

3. The apparatus of claim 1, wherein each of said trough members is inclined towards said outlet.

4. The apparatus of claim 1, wherein said first trough member is in fluid communication with a castor and the second trough is in fluid communication with a ladle device.

5. A method of changing the molten metal flow rate of the apparatus of claim 1, said method comprising installing the first combination and positioning a diverter such that molten metal flow to said first trough member is blocked and changing the molten metal flow rate by replacing the first combination with the second combination and repositioning said diverter such that molten metal flow to the second trough member is blocked.

6. The method of claim 5, further comprising measuring a depth of the molten metal within one of the first and second trough members and adjusting the speed of rotation of the impeller based on said measurement.

7. The method of claim 6, wherein a laser is used in the measurement of the molten metal level.

8. The method of claim 7, wherein said laser is in communication with a controller and said controller provides operating instructions to a motor associated with said pump.

9. A metal casting system comprising a molten metal pump configured for elevating a quantity of molten metal above a wall of a furnace, said pump in fluid communication with at least two troughs, a first trough having a first volume and a second trough having a second volume greater than the first volume, and a diverter positioned to selectively permit molten metal to enter one of the first or second troughs, wherein said second trough is in fluid communication with a ladle and said first trough is in fluid communication with a caster wherein said pump is provided with interchangeable shaft and impeller combinations, at least two of said combinations having different flow profiles but approximately the same exterior dimensions, each impeller including passages between a bottom inlet and a side outlet, the impeller of a first combination having larger passages than the impeller of a second combination, the passages of the second impeller having a wider outlet than inlet, and the impeller of the first combination including pockets disposed in a sidewall.

10. The metal casting system of claim 9, wherein said pump comprises:

a vessel disposed in the furnace;

a dividing wall dividing the vessel into a first chamber and a second chamber, the dividing wall having a height H1;

the molten metal pump positioned in the first chamber, the pump generating a flow of molten metal from the first chamber into the second chamber, wherein part of the second chamber has a height H2, and wherein H2 is less than H1; and wherein when the pump is activated molten metal is pumped from the first chamber into the second chamber until the level of molten metal in the second chamber exceeds H2 and moves past the opening and out of the second chamber and into one of the first or second troughs.

11. The metal casting system of claim 9, wherein said pump comprises an elongated tube having a first inlet end disposed in said furnace and a second outlet end disposed above the furnace and in fluid communication with said trough members, a shaft and impeller disposed within said tube and a motor engaging said shaft.

12. The metal casting system of claim 9 further comprising an apparatus configured to determine the depth of molten metal in at least one of said first and second trough.

13. The metal casting system of claim 12, wherein said apparatus is in communication with a controller and said controller instructs a motor associated with said pump.

14. The metal casting system of claim 9, wherein said shaft and impeller combinations include a quick disconnect feature.

15. The metal casting system of claim 9, wherein said diverter is comprised of a refractory material.

* * * * *